United States Patent [19]

Aoyama

[11] 4,130,093

[45] Dec. 19, 1978

[54] EXHAUST GAS RECIRCULATION CONTROL SYSTEM

[75] Inventor: Syunichi Aoyama, Yokohama, Japan

[73] Assignee: Nissan Motor Company, Limited, Japan

[21] Appl. No.: 786,812

[22] Filed: Apr. 12, 1977

[30] Foreign Application Priority Data

Apr. 13, 1976 [JP] Japan ..... 51-41590

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,926,161 | 12/1975 | Wertheimer | 123/119 A |
| 3,970,061 | 7/1976 | Caldwell | 123/119 A |
| 3,973,535 | 8/1976 | Sugihara et al. | 123/119 A |
| 3,974,807 | 8/1976 | Nohira et al. | 123/119 A |
| 3,981,283 | 9/1976 | Kaufman | 123/119 A |
| 4,027,638 | 6/1977 | Moriya et al. | 123/119 A |
| 4,031,871 | 6/1977 | Hamanishi | 123/119 A |
| 4,041,917 | 8/1977 | Suzuki | 123/119 A |
| 4,046,120 | 9/1977 | Laprade et al. | 123/119 A |
| 4,071,003 | 1/1978 | Aono | 123/119 A |

*Primary Examiner*—Wendell E. Burns

*Attorney, Agent, or Firm*—Robert E. Burns; Emmanuel J. Lobato; Bruce L. Adams

[57] ABSTRACT

An EGR control valve operating diaphragm unit operated by the difference between an exhaust gas pressure in a chamber interposed between the EGR control valve and a restriction provided in the EGR passageway upstream of the EGR control valve and a venturi vacuum in the engine intake passageway or a combination of an EGR control valve operating diaphragm unit operated by the difference between the atmospheric pressure and an engine suction vacuum and a pressure regulating valve controlling the flow of atmospheric air admitted for diluting the suction vacuum which diaphragm unit or combination operates the EGR control valve to reduce and increase the exhaust gas pressure in the chamber in the EGR passageway in accordance with increases and decreases in the venturi vacuum, respectively.

7 Claims, 3 Drawing Figures

EXHAUST GAS RECIRCULATION CONTROL SYSTEM

BACKGROUND OF THE INVENTION

1. Field of the Invention

The present invention relates generally to an exhaust gas recirculation (EGR) control system of a type which comprises an EGR passageway having a restriction formed upstream of the EGR control valve to define a chamber between the restriction and the EGR control valve and particularly to an EGR control system of this type in which the EGR control valve is operated to reduce and increase the exhaust gas pressure in the chamber between the restriction and the EGR control valve in accordance with increases and decreases in the venturi vacuum, respectively.

2. Description of the Prior Art

As is well known in the art, an exhaust gas recirculation (EGR) control system serves to reduce the production of nitrogen oxides (NOx) in combustion of an internal combustion engine by controlling the maximum combustion temperature below a certain level by recirculating or feeding into air drawn by the engine exhaust gas emitted from the engine. Accordingly, it is necessary to control the flow of recirculated engine exhaust gas with enough consideration for the operating performance or driveability and the fuel consumption of the engine.

It is usually desirable to maintain at a predetermined or constant valve the EGR ratio, that is, the ratio of the recirculated exhaust gas flow to the flow of air taken into the engine. As an expedient for attaining this purpose, there is proposed an EGR control system of a back pressure proportioning type as shown in FIG. 1 of the accompanying drawings. This conventional EGR control system comprises an EGR passageway 1 formed therein with a restriction or orifice 2 for controlling the recirculated exhaust gas flow, an EGR control valve 3 disposed in the EGR passageway 1 downstream of the restriction 2, and a diaphragm unit including a flexible diaphragm 4 which is operatively connected to the EGR control valve 3 and has on a side thereof a fluid chamber 5 fed with a suction vacuum. The EGR passageway 1 has a chamber 6 defined between the restriction 2 and the EGR control valve 3. A pressure converting valve 7 is provided for controlling the flow of atmospheric air admitted for diluting the suction vacuum fed into the fluid chamber 5 and includes a flexible diaphragm 8 operatively connected to the valve 7 and having on a side thereof a fluid chamber 9 communicating with the chamber 6 of the EGR passageway 1. The valve 7 is operated in accordance with a pressure $P_o$ in the chamber 6 and controls the suction vacuum in the fluid chamber 5 to a value related to the pressure $P_o$. The degree of opening of the EGR control valve 3 is feedback controlled by the suction vacuum in the fluid chamber 5 to maintain the pressure $P_o$ in the chamber 6 constant during most of engine operations. As a result, the recirculated exhaust gas flow is represented as a function of the pressure P of engine exhaust gas in the EGR passageway 1 upstream of the restriction 2 which pressure P is about proportional to the square of the engine taken air flow. Accordingly, the recirculated exhaust gas flow is controlled to an about constant ratio to the engine intake air flow.

When the recirculated exhaust gas flow is a function of the pressure P of exhaust gas in the EGR passageway 1 upstream of the orifice 2 in this manner, the recirculated exhaust gas flow is very easily affected by variations in the exhaust gas pressure P. Accordingly, when the exhaust gas pressure P is not proportional to the square of the engine taken air flow, the reliability on the control of the recirculated exhaust gas flow which is effected by the conventional EGR control system is considerably reduced.

The exhaust gas pressure is often varied independently of the engine taken air flow by parameters such as the injection of secondary air into the exhaust gas system, the temperature of the engine exhaust gas, the flow resistance of the exhaust gas passageway and so on. Accordingly, the exhaust gas pressure is highly unreliable as compared with a carburetor venturi vacuum as a function of the engine taken air flow.

Furthermore, since the exhaust gas pressure P does not have such a large absolute value and is vaired over a fairly wide range, the conventional EGR control system has been unable to control the EGR ratio to a constant or predetermined value. As a result, the conventional EGR control system has been apt to unsatisfactorily reduce the production of nitrogen oxides and to render the driveability of the engine unstable.

On the other hand, a conventional EGR control system has recirculated engine exhaust gas at a similar predetermined EGR ratio throughout all engine operating conditions. As a result, under high speed and low load engine operating condition in which the production of nitrogen oxides (NOx) is relatively small, the recirculated exhaust gas flow has become excessive to degrade the driveability and the fuel consumption i.e. fuel economy of the engine.

It is, therefore, an object of the invention to provide an EGR control system improved to comprise means for varying the pressure in the chamber interposed between the restriction and the EGR control valve in accordance with variations in a venturi vacuum in the engine intake passageway to prevent the recirculated exhaust gas flow from being greatly affected by variations in the exhaust gas pressure in the EGR passageway upstream of the chamber and to render the recirculated exhaust gas flow dependent on the pressure differential between the EGR passageway upstream of the orifice and the chamber between the orifice and the EGR control valve so that the recirculated exhaust gas flow is accurately controlled.

It is a further object of the invention to provide an EGR control system improved to comprise means for reducing the EGR ratio to prevent the driveability and the fuel consumption of the engine from being degraded during high speed and low load engine operating condition.

These objects are attained by operating the EGR control valve in accordance with the difference between the pressure in the EGR passageway between the restriction and the EGR control valve and the venturi vacuum, or by providing a control valve for controlling in accordance with the difference between, the atmospheric pressure, the pressure in the EGR passageway between the restriction and the EGR control valve, and the venturi vacuum, the flow of atmospheric air admitted for diluting the suction vacuum for operating the EGR control valve and additionally by providing a check valve for admitting in response to a suction vacuum increased above a predetermined value the suction vacuum into the atmospheric pressure for operating the control valve.

BRIEF DESCRIPTION OF THE DRAWINGS

These and other features and advantages of the invention will become more apparent from the following detailed description taken in connection with the accompanying drawings in which.

DESCRIPTION OF THE SPECIFIC EMBODIMENTS

Figure 1:
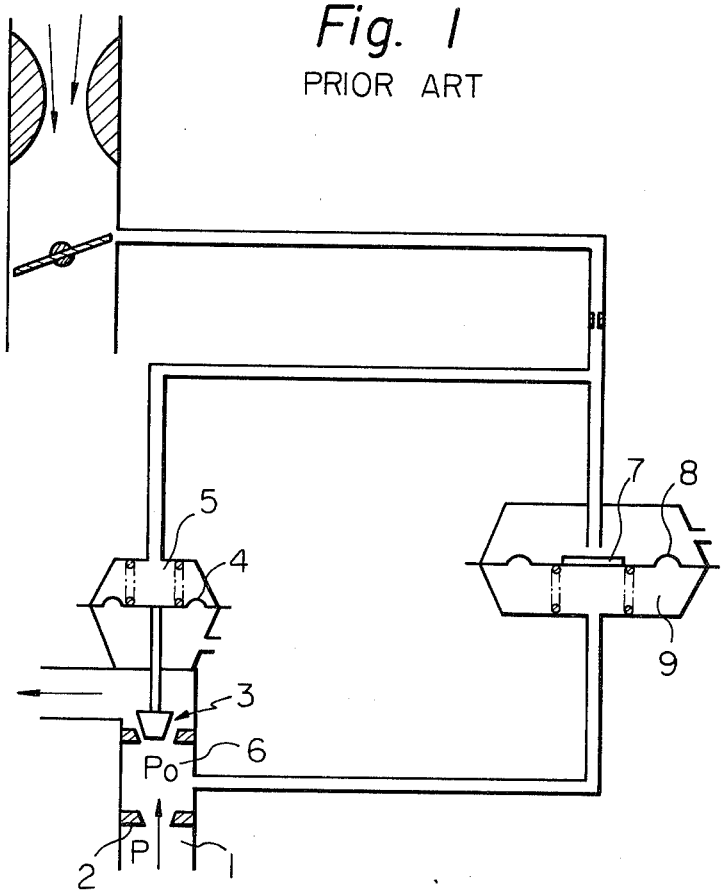
Fig. 1 PRIOR ART
FIG. 1 is a schematic view of the conventional EGR control system as per the introduction of the present specification.
Figure 2:
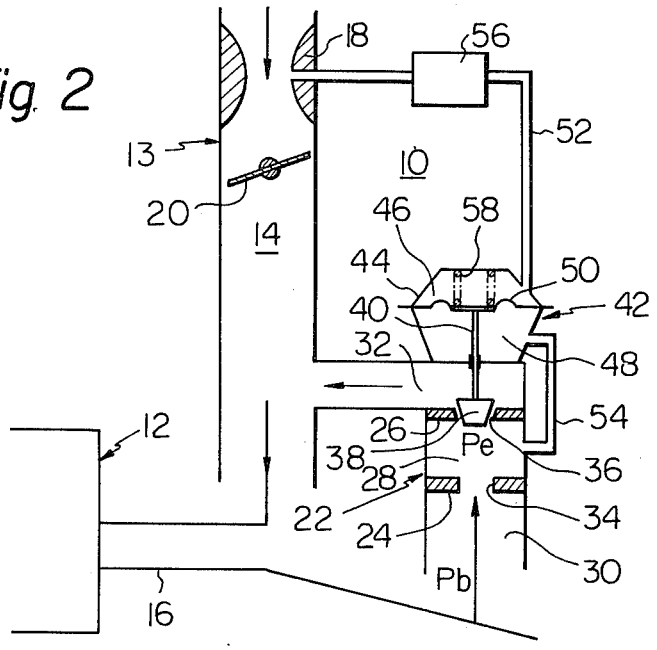
FIG. 2 is a schematic view of a first preferred embodiment of an EGR control system according to the invention.

Referring to FIG. 2 of the drawings, there is shown an exhaust gas recirculation (EGR) control system according to the invention. The EGR control system, generally designated by the reference numeral 10, is combined with an internal combustion engine 12 including a carburetor 13, an intake passageway 14 passing through the carburetor 13 and providing communication between the atmosphere and the engine 12 for conducting air thereinto, and an exhaust gas passageway 16 providing communication between the engine 12 and the atmosphere for conducting thereto exhaust gas emitted from the engine 12. The intake passageway 14 has a venturi 18 formed therein and a throttle valve 20 rotatably mounted downstream of the venturi 18. The EGR control system 10 comprises an EGR passageway 22 providing communication between the exhaust gas passageway 16 and the intake passageway 14 downstream of the throttle valve 20 for recirculating or conducting engine exhaust gas into the intake passageway 14. The EGR passageway 22 is formed therein with partition members 24 and 26 which divide the EGR passageway 22 into a chamber 28 defined between the partition members 24 and 26 and upstream and downstream parts 30 and 32 located respectively upstream and downstream of the chamber 28. The partition member 24 is formed therethrough with an orifice 34 which provides communication between the upstream part 30 and the chamber 28 and forms together with the partition member 24 a restriction of the EGR passageway 22 which controls the flow of recirculated engine exhaust gas. The partition member 26 is formed therethrough with an aperture or passage 36 which provides communication between the chamber 28 and the downstream part 32.

An EGR control valve 38 is disposed in the EGR passageway 22 movably relative to the partition member 26. The EGR control valve 38 includes a valve stem 40 extending therefrom externally of the EGR passageway 22 and a diaphragm unit 42 for operating the EGR control valve 38. The diaphragm unit 42 comprises a housing 44 having first and second fluid chambers 46 and 48, and a flexible diaphragm 50 separating the fluid chambers 46 and 48 from each other. The fluid chamber 46 communicates with the venturi 18 through a passage 52 to receive a venturi vacuum, while the fluid chamber 48 communicates with the chamber 28 through a passage 54 and is fed thereinto with a pressure $P_e$ in the chamber 28. A vacuum increasing device 56 is provided in the passage 52 and serves to amplify a vaccum in the venturi 18 to a value proportional to the venturi vacuum and to feed the amplified venturi vacuum into the fluid chamber 46. The diaphragm 50 is operatively connected to the EGR control valve 38 through the valve stem 40 so that the EGR control valve 38 increases and reduces the effective cross sectional area of the passage 36 to reduce and increase the pressure $P_e$ in the chamber 28 in accordance with increases and decreases in the venturi vacuum, respectively. A spring 58 is provided to urge the diaphragm 50 in a direction opposed by the pressure in the fluid chamber 48 and the spring rate, that is, the ratio of applied force to resulting deflection, of the spring 58 is relatively small. As the vacuum amplifying device 56, a device can be employed which amplifies the venturi vacuum to a value proportional to the venturi vacuum by, for example, the area differential of two flexible diphragms having different effective working surface areas.

The EGR control system 10 thus described is operated as follows:

Since a vacuum prodused in the venturi 18 is exactly proportional to the square of the flow of air drawn by the engine 12, the venturi vacuum is increased in accordance with increases in the flow of air drawn by the engine 12.

When the venturi vacuum is increased a certain amount, the increased venturi vacuum is first amplified to a value proportional to the venturi vacuum by the vacuum amplifying device 56 and is then admitted into the fluid chamber 46 of the diaphragm unit 42. The diaphragm 50 is moved in opposition to the force of the spring 58 in response to the increased venturi vacuum to increase the degree of opening of the EGR control valve 38 and therefore to reduce the flow resistance of the passage 36. As a result, the pressure $P_e$ in the chamber 28 and therefore the pressure in the fluid chamber 48 are reduced (when the pressure $P_e$ is a negative pressure, the absolute value thereof is increased) to move the diaphragm 50 in a direction in which the degree of opening of the EGR control valve 38 is reduced. By the repetition of such an operation or by such a feedback control, the pressure $P_e$ in the chamber 28 is reduced to a value in which the pressure $P_e$ is balanced with the venturi vacuum and the degree of opening of the EGR control valve 38 is converged to a value corresponding to the value of the pressure $P_e$.

As the pressure $P_e$ in the chamber 28 is reduced in accordance with increases in the venturi vacuum and therefore the degree of opening of the EGR control valve 38, the flow of recirculated engine exhaust gas is increased. Accordingly, since the recirculated exhaust gas flow is increased in accordance with increases in the flow of air taken by the engine 12, the EGR rate is controlled to an about constant value. On the other hand, since the pressure of the engine exhaust gas is increased in accordance with increases in the engine taken air flow, the pressure $P_b$ in the upstream part 30 is also increased almost similarly to the engine exhaust gas pressure in accordance with increases in the engine taken air flow. Since the pressure $P_e$ in the chamber 28 is reduced in accordance with increases in the engine taken air flow, the pressure differential $P_b$-$P_e$ of the upstream part 30 and the chamber 28 is increased in accordance with increases in the engine taken air flow. Accordingly, the recirculated exhaust gas flow also depends upon the pressure differential $P_b$-$P_e$ upstream and downstream of the orifice 34 and is increased in accordance with increases in the pressure differential $P_b$-$P_e$.

In the EGR control system 10 in which the recirculated exhaust gas flow depends upon the pressure differential $P_b$–$P_e$ in this manner, since variations in the pressure differential $P_b$–$P_e$ due to variations in the exhaust gas pressure can be almost neglected, the recirculated exhaust gas flow is not almost affected by variations in the exhaust gas pressure due to parameters which are other than and are unrelated to the engine taken air flow. On the contrary, in the conventional EGR control system of the back pressure proportioning type in which the recirculated exhaust gas flow is a function of only the pressure $P_b$ in the upstream part 30, the recirculated exhaust gas flow is greatly affected or varied by variations in the exhaust gas pressure due to parameters unrelated to the engine taken air flow.

When the suction vacuum in the intake passageway 14 is varied by variations in the load of the engine 12 without the engine taken air flow or the venturi vacuum being varied, the pressure $P_e$ in the chamber 28 is first varied without the degree of opening of the EGR control valve 38 being varied and the pressure $P_e$ in the fluid chamber 48 is then varied. In this instance, when the suction vacuum is increased, the diaphragm 50 is moved in a direction in which the degree of opening of the EGR control valve 38 is reduced to return the pressure $P_e$ in the chamber 28 to a former value and prevent the pressure $P_e$ from being reduced. On the contrary, when the suction vacuum is reduced, the diaphragm 50 is moved in a direction in which the degree of opening of the EGR control valve 38 is increased to return the pressure $P_e$ in the chamber 28 to an initial value to prevent the pressure $P_e$ from being increased. As a result, the pressure $P_e$ in the chamber 28 and therefore the recirculated exhaust gas flow is prevented from being varied independently of the engine taken air flow and therefore the venturi vacuum to maintain the EGR ratio at a predetermined or set value.

In the EGR control system 10 the accuracy of controlling the recirculated exhaust gas flow is partially influenced by the pressure $P_e$ in the chamber 28 and the magnitudes of the pressure $P_e$ can be set at certain optimum values by properly selecting the rate of amplification of the venturi vacuum by the vacuum amplifying device 56, the effective working or pressure acting surface area of the diaphragm 50, the coefficient of elasticity of the spring 58, the cross sectional area of the orifice 34 and so on so as to provide a predetermined and desirable EGR ratio.

When the diaphragm 50 of the EGR control valve 38 has a relatively large working surface area, the vacuum amplifying device 56 can be dispensed with.

Figure 3:
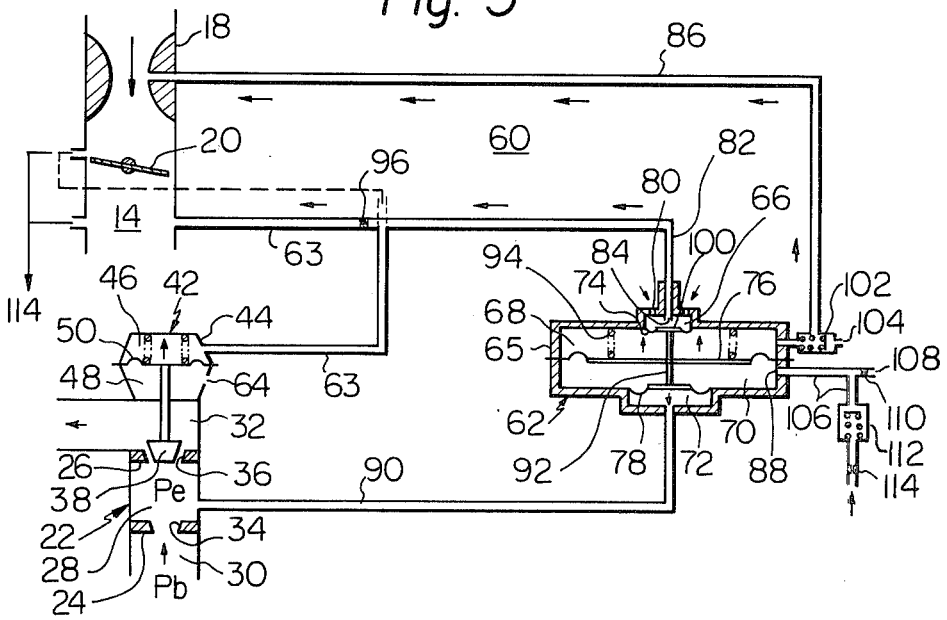
FIG. 3 is a schematic view of a second preferred embodiment of an EGR control system according to the invention.

Referring to FIG. 3 of the drawings, there is shown a second preferred embodiment of an EGR control system according to the invention. In FIG. 3, like component elements and parts are designated by the same reference numerals as those used in FIG. 2. The EGR control system, generally designated by the reference numeral 60, is characterized in that a pressure regulating valve assembly 62 is provided which controls the vacuum for operating the EGR control valve 38. In this embodiment, the fluid chamber 46 of the diaphragm unit 42 communicates with the intake passageway 14 downstream of the throttle valve 20 through a passage 63 to receive a suction vacuum in the passageway 14. Alternatively, the fluid chamber 46 may communicate with the intake passageway 14 at a location which is just on the atmospheric or upstream side of the peripheral edge of the throttle valve 20 in its fully closed position and is varied to the suction vacuum or downstream side of the throttle valve 20 opened above a certain amount. The fluid chamber 48 of the diaphragm unit 42 communicates with the atmosphere through an opening 64.

The pressure regulating valve assembly 62 comprises a housing 65 having therein four chambers 66, 68, 70 and 72, and three flexible diaphragms 74, 76 and 78. The diaphragm 74 separates the chambers 66 and 68 from each other. The diaphragm 76 separates the chambers 68 and 70 from each other. The diaphragm 78 separates the chambers 70 and 72 from each other. The chamber 66 communicates with the atmosphere through an opening 80 and with the passage 63 through a passage 82 and an inlet port 84. The chamber 68 communicates with the venturi 18 through a passage 86. The chamber 70 communicates with the atmosphere through an opening 88. The chamber 72 communicates with the chamber 28 of the EGR passageway 22 through a passage 90. The diaphragm 76 has a working or pressure acting surface area larger than that of each of the diaphragms 74 and 78. The diaphragms 74, 76 and 78 are fixedly connected to each other by a rod 92 so that they are operated as one body. A spring 94 is provided to urge the integral diaphragms 74, 76 and 78 in a direction opposed by the atmospheric pressure in the chamber 70. An orifice 96 is formed in the passage 63 on the intake passageway side of the junction of the passages 63 and 82. A control valve 100 is located in the chamber 66 movably relative to the port 84 to control the flow of atmospheric air into the port 84 and is fixedly secured to the diaphragm 74.

A relief valve 102 is disposed in the passage 86 and the passage 86 has a port 104 providing communication between the passage 86 and the atmosphere. The relief valve 102 closes and opens the port 104 to obstruct and provide communication between the passage 86 and the atmosphere when the venturi vacuum is below and above a predetermined value, respectively.

A passage 106 provides communication between the opening 88 and the intake passageway 14 downstream of the throttle valve 20 and/or just upstream of the throttle valve 20 in its fully closed position to conduct into the chamber 70 the suction vacuum and/or a so-called VC pressure which is atmospheric pressure when the throttle valve 20 is fully closed and is the suction vacuum when the throttle valve 20 is opened above a certain amount. The passage 106 has a port 108 providing communication between the passage 106 and the atmosphere and formed therein with an orifice 110. A check valve 112 is disposed in the passage 106 on the intake passageway side of the port 108 and closes and opens the passage 106 to obstruct and provide communication between the chamber 70 and the intake passageway 14 when either or the sum of the suction vacuum and the VC pressure is below and above a predetermined value, respectively. An orifice 114 is formed in the passage 106 on the intake passageway side of the check valve 112. If desired, the relief valve 102, the port 104, the passage 106 and the check valve 112 can be dispensed with.

The EGR control system 60 thus described is operated as follows:

When the venturi vacuum is increased, the diaphragms 74, 76 and 78 are integrally moved to reduce the degree of opening of the control valve 100 to the port 84 to reduce the flow of atmospheric air admitted into the passage 82 and therefore the degree of diluting a suction vacuum conducted into the chamber 46. As a result, the degree of opening of the EGR control valve 38 is increased to reduce the pressure $P_e$ in the chamber 28 and therefore in the chamber 72 of the valve assembly 62. The decrease in the pressure $P_e$ moves the diaphragms 74, 76 and 78 integrally to increase the degree of opening of the control valve 100 to the port 84 to increase the flow of atmospheric air admitted into the passage 82. As a result, the dilution of the suction vacuum by the atmospheric air is increased to reduce the degree of opening of the EGR control valve 38 to increase the pressure $P_e$ in the chamber 28. By the repetition of such an operation or such a feedback control, the pressure $P_e$ and the degree of opening of the EGR control valve 38 are converged respectively to values in which the pressure $P_e$ is balanced with the venturi vacuum to increase and reduce the recirculated exhaust gas flow in accordance with the increases and decreases in the venturi vacuum.

When the pressure $P_e$ in the chamber 28 is varied regardless of the venturi vacuum by variations in the suction vacuum, the EGR control valve 38 is operated to cancel the variations in the pressure $P_e$ by the pressure regulating valve assembly 62. In this instance, when the pressure $P_e$ is a negative pressure and the negative pressure is increased, the diaphragms 74, 76 and 78 are integrally moved to increase the degree of opening of the control valve 100 to the port 84. As a result, the degree of opening of the EGR control valve 38 is reduced similarly as mentioned above to reduce the influence of the suction vacuum on the pressure $P_e$ to restore same to an initial value to prevent the recirculated exhaust gas flow from being varied irrespective to the venturi vacuum.

When the relief valve 102 is provided and the venturi vacuum reaches the predetermined value during operations of the engine 12 under both a high speed and a high load, the relief valve 102 is opened to admit atmospheric air into the chamber 68 to prevent the degree of opening of the control valve 100 to the port 84 from being reduced above a predetermined amount even if the venturi vacuum is increased above the predetermined value. Accordingly, the pressure $P_e$ in the chamber 28 is prevented from being reduced below a predetermined level to prevent the recirculated exhaust gas flow from being increased above a predetermined value. As a result, the EGR ratio is reduced to prevent the fuel consumption from being increased and the operating performance from being degraded during the engine high speed and high load operating condition.

In this instance, it is desirable and necessary to set the absolute value of the pressure $P_e$ in the chamber 28 at a large value as compared with the pressure $P_b$ in the upstream part 30 in order to reduce the influence exerted on the pressure $P_e$ by the pressure $P_b$ which is increased with increases in the engine taken air flow during the engine high speed and high load operation.

When the passage 106 and the check valve 112 are provided and the engine 12 is in a high speed and low load operating condition in which either or the sum of the suction vacuum and the VC vacuum is increased above the predetermined value, the check valve 112 is opened to admit the suction vacuum and/or the VC pressure into the chamber 70 to cancel the venturi vacuum in the chamber 68 a certain degree. Accordingly, the degree of opening of the EGR control valve 38 is prevented from being increased above a predetermined value to keep the pressure $P_e$ in the chamber 28 above a predetermined level to prevent the recirculated exhaust gas flow from being increased above a certain amount. As a result, the EGR ratio is reduced to increase the stability of operation, the fuel economy and the operating performance of the engine 12 during the engine high speed and low load operation in which the production of nitrogen oxides (NOx) is extremely small.

In the EGR control systems 10 and 60, in lieu of the partition member 24 formed with the orifice 34 passage means such as a conduit, pipe, tube or the like can be employed which has the same effective cross sectional area as that of the orifice 34 and serves as the upstream part 30 of the EGR passageway 22, as a restriction for restricting the flow of exhaust gas passing in the EGR passageway 22.

Although the venturi 18 is shown to be formed in an intake passageway of an engine including a carburetor, it can be formed in an intake passageway of an engine of a fuel injection type.

It will be appreciated that the invention provides an EGR control system in which the EGR control valve is operated to control the recirculated exhaust gas flow by varying the exhaust gas pressure in the chamber between the restriction and the EGR control valve in accordance with variations in a venturi vacuum in an engine intake passageway to prevent the recirculated exhaust gas flow from being affected by the exhaust gas pressure in the EGR passageway upstream of the chamber and as a result which accurately controls the recirculated exhaust gas flow in accordance with the engine taken air flow to satisfactorily reduce the production of nitrogen oxides (NOx) and to increase the stability of operation of the engine.

It will be also appreciated that the invention provides an EGR control system which controls the recirculated exhaust gas flow at a suitably reduced EGR ratio to increase the operating performance and the fuel economy of the engine during low load engine operating conditions in which the production of nitrogen oxides is relatively small.

What is claimed is:

1. An exhaust gas recirculation (EGR) control system in combination with an internal combustion engine including an intake passage providing communication between the atmosphere and the engine and having a venturi formed therein, and an exhaust gas passageway providing communication between the engine and the atmosphere, said EGR control system comprising an EGR passageway providing communication between the exhaust gas passageway and the intake passageway for recirculating thereinto exhaust gas emitted from the engine, said EGR passageway having provided therein a restriction for restricting said EGR passageway;

an EGR control valve which is disposed in said EGR passageway downstream of said restriction to define a first chamber interposed between said restriction and said EGR control valve and is operable in opposite directions to increase and reduce the pressure of engine exhaust gas in said first chamber for controlling the flow of recirculated engine exhaust gas; and operating means for operating said EGR control valve in opposite directions to increase and reduce the exhaust gas pressure in said first chamber in accordance with a decrease and an increase in said exhaust gas pressure and in accordance with a decrease and an increase in a venturi vacuum in said venturi, respectively.

2. An EGR control system as claimed in claim 1, in which said operating means comprises a second chamber communicating with said venturi to receive said venturi vacuum, a third chamber communicating with said first chamber to receive said exhaust gas pressure, a flexible diaphragm separating said second and third chambers from each other and operatively connected to said EGR control valve so that said EGR control valve is operated in opposite directions to increase and reduce said exhaust gas pressure in response to a decrease and an increase in said venturi vacuum in said second chamber, respectively.

3. An EGR control system as claimed in claim 1, in which said operating means comprises a second chamber communicating with said intake passageway to receive therein a vacuum from a vacuum source, a third chamber communicating with the atmosphere, a flexible diaphragm separating said second and third chambers from each other and operatively connected to said EGR control valve so that said EGR control valve is operated in opposite directions to increase and reduce said exhaust gas pressure in response to a decrease and an increase in said vacuum in said second chamber, respectively, passage means communicating with said second chamber and having an inlet port communicating with the atmosphere for admitting into said passage means atmospheric air for diluting said vacuum in said second chamber, a pressure regulating valve located movable relative to said inlet port of said passage means for controlling the flow of atmospheric air admitted into said inlet port, and second operating means operatively connected to said pressure regulating valve so that said pressure regulating valve reduces and increases the flow of atmospheric air into said inlet port in response to an increase and a decrease in said venturi vacuum and in response to an increase and a decrease in said exhaust gas pressure for reducing and increasing the dilution of said vacuum in said second chamber by atmospheric air for causing said diaphragm to operate said EGR control valve in opposite directions to reduce and increase said exhaust gas pressure, respectively.

4. An EGR control system as claimed in claim 3, in which said second operating means comprises a fourth chamber communicating with said venturi to receive said venturi vacuum therefrom, a fifth chamber communicating with the atmosphere, a sixth chamber communicating with said first chamber to receive said exhaust gas pressure therefrom, a second flexible diaphragm separating said fourth and fifth chambers from each other, and a third flexible diaphragm separating said fifth and sixth chambers from each other and fixedly connected to said second diaphragm, said second and third diaphragms being operatively connected to said pressure regulating valve so that said pressure regulating valve is operated to reduce and increase the flow of atmospheric air into said inlet port in response to an increase and a decrease in said venturi vacuum in said fourth chamber and in response to an increase and a decrease in said exhaust gas pressure in said sixth chamber, respectively.

5. An EGR control system as claimed in claim 4, in which said second operating means further comprises second passage means providing communication between said venturi and said fourth chamber, and a relief valve disposed in said second passage means and providing communication between said fourth chamber and the atmosphere in response to a venturi vacuum in said second passage means above a predetermined value to prevent said pressure regulating valve from reducing the flow of atmospheric air into said inlet port below a predetermined level during high speed and high load operating condition of said engine.

6. An EGR control system as claimed in claim 4, in which said intake passageway has a throttle valve rotatably mounted therein, said second operating means further comprises second passage means providing communication between said fifth chamber and said intake passageway downstream of said throttle valve, and a check valve disposed in said second passage means and closing said second passage means in response to a vacuum in said second passage means below a predetermined value and opening said second passage means in response to a vacuum in said second passage means above said predetermined value to prevent said pressure regulating valve from reducing the flow of atmospheric air into said inlet port below a predetermined level during high speed and low load operating condition of the engine.

7. An EGR control system as claimed in claim 6, in which said second passage means further communicates with said intake passageway at a location which is on the atmospheric side of the throttle valve in its fully closed position and is varied to the suction vacuum side of the throttle valve opened a certain amount.

* * * * *